United States Patent [19]

Rieger et al.

[11] Patent Number: 5,000,095

[45] Date of Patent: Mar. 19, 1991

[54] PROJECTILE WITH AN EJECTING CHARGE

[75] Inventors: Gerald Rieger, Nurnberg; Helmut Hammer, Heroldsberg; Erich Bock, Nuremberg, all of Fed. Rep. of Germany

[73] Assignee: Diehl GmbH & Co., Nurnberg, Fed. Rep. of Germany

[21] Appl. No.: 416,585

[22] Filed: Oct. 3, 1989

[30] Foreign Application Priority Data

Oct. 15, 1988 [DE] Fed. Rep. of Germany ..... 3835150

[51] Int. Cl.[5] ..... F42B 12/58

[52] U.S. Cl. ..... 102/489; 102/479; 102/499

[58] Field of Search ..... 102/430, 473, 505, 340, 102/342, 351, 357, 479, 489, 499, 500

[56] References Cited

U.S. PATENT DOCUMENTS

| | | | |
|---|---|---|---|
| 2,446,187 | 8/1948 | Meister | 102/202 |
| 2,454,281 | 11/1948 | Hicks | 102/489 |
| 3,151,447 | 10/1964 | Bornstein | 60/39.47 |
| 4,498,394 | 2/1985 | Regebro | 102/489 |

FOREIGN PATENT DOCUMENTS

| | | | |
|---|---|---|---|
| 72049 | 5/1943 | Czechoslovakia | 102/473 |
| 271480 | 12/1987 | European Pat. Off. . | |
| 2854120 | 6/1980 | Fed. Rep. of Germany . | |
| 3048618 | 7/1982 | Fed. Rep. of Germany . | |
| 3616410 | 11/1987 | Fed. Rep. of Germany . | |
| 2343987 | 10/1977 | France . | |
| 2591735 | 6/1987 | France . | |
| 2182124 | 5/1987 | United Kingdom | 102/499 |

OTHER PUBLICATIONS

Europen Search Report.

*Primary Examiner*—Charles T. Jordan
*Assistant Examiner*—Stephen Johnson
*Attorney, Agent, or Firm*—Scully, Scott, Murphy & Presser

[57] ABSTRACT

A projectile with an ejecting charge for the expulsion of a payload. The ejecting charge effectively develops a pressure which is of sufficient duration and adequately high for effectuating the expulsion of the payload; however, wherein the casing thereof will not burst into the kind of fragments which conceivably can damage the payload. A receiving member for the ejecting charge is mounted within the projectile, which receiving member withstands the development of the pressure encountered during the combusting of the ejecting charge; wherein that the receiving member possesses a multiplicity of apertures through which there discharges the propellent gas which is developed during the combustion of the ejecting charge, and wherein the ejecting charge is inserted into a thin-walled cup contained in the receiving member.

6 Claims, 1 Drawing Sheet

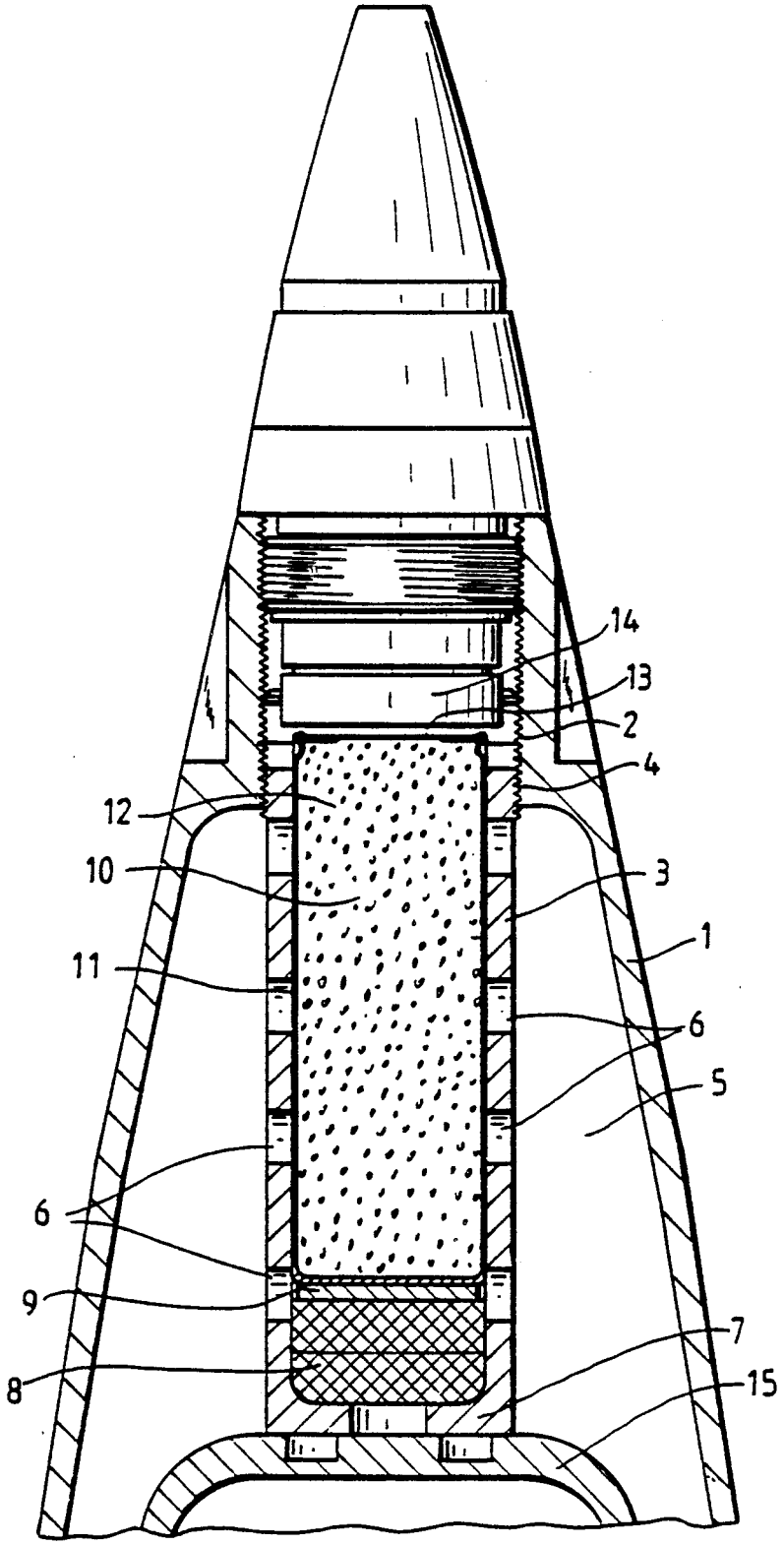
14
13
2
4
12
10
3
1
11
6
5
6
9
7
8
15

PROJECTILE WITH AN EJECTING CHARGE

BACKGROUND OF THE INVENTION

1. Field of the Invention

The present invention relates to a projectile with an ejecting charge for the expulsion of a payload.

2. Discussion of the Prior Art

In a projectile, for the effectuating of an assured expulsion of the payload, the ejecting charge should develop gas which is under a high pressure over a comparatively lengthy period of time. For this purpose, it is necessary to provide a secure damming or containment at the beginning of the combusting of the ejecting charge. In accordance with the state-of-the-art, the ejecting charge is arranged within a thick-walled cup which is constituted from aluminum. The cup bursts during the combustion into coarse fragments. These fragments can damage the payload which is to be expelled.

SUMMARY OF THE INVENTION

Accordingly, it is an object of the present invention to provide a projectile of the type described herein in which the ejecting charge effectively develops a pressure which is of sufficient duration and adequately high for effectuating the expulsion of the payload; however, wherein the casing thereof will not burst into the kind of fragments which conceivably can damage the payload.

Inventively, the foregoing object is attained in that a receiving member for the ejecting charge is mounted within the projectile, which receiving member withstands the development of the pressure encountered during the combusting of the ejecting charge; wherein that the receiving member possesses a multiplicity of apertures through which there discharges the propellent gas which is developed during the combustion of the ejecting charge, and wherein the ejecting charge is inserted into a thin-walled cup contained in the receiving member.

The receiving member provides the necessary damming for the ejecting charge. During the combusting of the ejecting charge, as a consequence of the development of the pressure, the wall segments of the thin-walled cup which are located in the region of the apertures are forced through the apertures and the developing propellent gas streams through the apertures and leads to the expulsion of the payload. The minute wall segments of the cup which are forced through the apertures do not cause any damage to the payload.

BRIEF DESCRIPTION OF THE DRAWINGS

Advantageous embodiments of the invention may now be readily ascertained from the following detailed description of an exemplary embodiment thereof, taken in conjunction with the accompanying single figure of drawing illustrating, in a longitudinal sectional view, the head end portion of a projectile.

DETAILED DESCRIPTION

Referring in detail to the drawing, a projectile casing 1 incorporates an internal screwthread 2. Into the screwthread there is screwed a cylindrical receiving member 3 possessing a complementary external screwthread 4. The receiving member 3 projects into a pressure chamber 5 within the projectile casing 1. The receiving member is of a thick-walled and resultingly such rigid construction, so as not to be destroyed during the combusting of an ejecting charge. A multiplicity of apertures 6 are provided on the receiving member 3, which apertures are distributed in both the longitudinal direction and circumferential direction about the receiving member 3.

The receiving member 3 possesses a bottom 7 having a felt pad 8 and an intermediate plate 9 inserted therein. An ejecting charge 10 is inserted into the receiving member 3, which has an NC propellent powder charge 12 contained within a thin-walled cup 11. For example, the cup 11 may consist of either aluminum or cardboard. The cup 11 is closed off from above by means of a cover 13, which is constituted from either aluminum or cardboard. Adjoining the cover 13, a fuze device 14 is screwed into the internal screwthread 2.

Immediately contiguous to the bottom 7 a payload 15 which is to be expelled is arranged within the projectile casing 1.

The manner of operation of the inventive arrangement is generally somewhat as follows:

When the propellent powder charge 12 is ignited by action of the fuze device 14, a pressure will then develop therein which will allow for the sequential breaking of the wall segments of the cup 11 in the region of the apertures 6 so as to pass through the apertures 6. The propellent gas streams through the apertures to into the pressure chamber 5. The payload 15 is thereby ejected outwardly.

What is claimed is:

1. A projectile with an ejecting charge for the expulsions of a payload, comprising a receiving member surrounding said ejecting charge both mounted within a casing of said projectile, said receiving member having structure for withstanding development of pressure produced during a combusting of said ejecting charge, said receiving member including a cylindrical body having a multiplicity of apertures formed therein dispersed longitudinally along and circumferentially about said cylindrical body of said receiving member for a discharge therethrough of propellant gas developed during the combusting of said ejecting charge; and a thin-walled cup located within said receiving member for receiving said ejecting charge.

2. A projectile as claimed in claim 1, wherein said receiving member is fastened by a screwthread to said projectile casing.

3. A projectile as claimed in claim 1, wherein the cup is supported on a felt pad positioned on a bottom of the receiving member; and fuze means being arranged at an end of the receiving member opposite said bottom.

4. A projectile as claimed in claim 3, wherein said fuze means and said receiving member are screwed into a common screwthread in the projectile casing.

5. A projectile as claimed in claim 1, wherein said cup is constituted from aluminum.

6. A projectile as claimed in claim 1, wherein said cup is constituted from cardboard.

* * * * *